US006442897B1

(12) United States Patent
Mullet

(10) Patent No.: US 6,442,897 B1
(45) Date of Patent: Sep. 3, 2002

(54) COUNTERBALANCE SYSTEM CABLE DRUM FOR SECTIONAL DOORS

(75) Inventor: Willis J. Mullet, Pensacola Beach, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/626,661

(22) Filed: Jul. 27, 2000

(51) Int. Cl.[7] ..... E05F 15/00
(52) U.S. Cl. ..... 49/199; 49/200; 160/201
(58) Field of Search ..... 49/199, 200, 201, 49/197; 160/188, 189, 201

(56) References Cited

U.S. PATENT DOCUMENTS

| | | | | |
|---|---|---|---|---|
| 1,489,902 | A | 4/1924 | Segelhorst | 254/383 |
| 1,646,207 | A | 10/1927 | McSheen | 254/383 |
| 2,020,831 | A | 11/1935 | Greegor | 20/20 |
| 2,092,774 | A | 9/1937 | Osgood | 254/185 |
| 2,314,015 | A | 3/1943 | Parsons | 16/198 |
| 2,946,562 | A | 7/1960 | Handley | 254/161 |
| 3,038,535 | A | 6/1962 | Stroup et al. | 160/191 |
| 3,160,200 | A | 12/1964 | McKee et al. | 160/189 |
| 3,224,492 | A | 12/1965 | Houk | 160/189 |
| 3,248,087 | A | 4/1966 | Hallen | 254/167 |
| 3,367,633 | A | 2/1968 | Kratzer et al. | 254/186 |
| 3,412,780 | A | 11/1968 | Moler | 160/191 |
| 3,938,781 | A | 2/1976 | Craven et al. | 254/175.7 |
| 3,952,965 | A | 4/1976 | Falcon | 242/96 |
| 4,034,932 | A | 7/1977 | Ferch | 242/117 |
| 4,191,237 | A | 3/1980 | Voege | 160/188 |
| 4,483,496 | A | 11/1984 | Weinlich | 242/158 |
| 4,541,584 | A | 9/1985 | Rivinius | 242/158 |
| 4,570,875 | A | 2/1986 | Buluschek | 242/158 |
| 4,795,108 | A | 1/1989 | Appling | 242/157.1 |
| 4,882,806 | A | 11/1989 | Davis | 16/198 |
| 5,002,238 | A | 3/1991 | Inhofer et al. | 242/157.1 |
| 5,025,591 | A | 6/1991 | DeLand et al. | 49/360 |
| 5,267,702 | A | 12/1993 | Schumacher et al. | 242/54 |
| 5,335,883 | A | 8/1994 | Mawer | 242/602.1 |
| 5,419,010 | A | 5/1995 | Mullet | 16/198 |
| 5,557,887 | A | 9/1996 | Fellows et al. | 49/28 |
| 5,615,723 | A | 4/1997 | Carper | 160/191 |
| 5,636,678 | A | 6/1997 | Carper et al. | 160/191 |
| 5,803,149 | A | 9/1998 | Halley et al. | 160/201 |
| 5,865,235 | A | 2/1999 | Krupke et al. | 160/191 |
| 5,931,212 | A | 8/1999 | Mullet et al. | 160/188 |

FOREIGN PATENT DOCUMENTS

| | | | |
|---|---|---|---|
| EP | 0 716 203 A1 | 12/1996 | E05F/15/16 |
| GB | 590231 | 7/1947 | |

*Primary Examiner*—Curtis A. Cohen
(74) *Attorney, Agent, or Firm*—Renner, Kenner, Greive, Bobak, Taylor & Weber

(57) ABSTRACT

A counterbalance system (10) for an upwardly acting door (D) movable on tracks (T, T) between a closed position and an open position having, a drive tube (31) adapted to be mounted above the door in the closed position, a cable drum assembly (30) mounted proximate each end of the drive tube, a cable connecting each cable drum assembly and the door, a cylindrical member (40) on the cable drum assembly, a cable receiving surface (42) on the cylindrical member extending laterally between the door and the tracks and receiving multiple layers (F, S) of the cable during movement of the door from the closed position to the open position, whereby the cable avoids engagement with the door during movement between the closed position and the open position.

7 Claims, 4 Drawing Sheets

COUNTERBALANCE SYSTEM CABLE DRUM FOR SECTIONAL DOORS

TECHNICAL FIELD

The present invention relates generally to counterbalance systems for upwardly acting sectional doors. More particularly, the present invention relates to cable storage drums which pay out and retrieve cable interconnecting the door with the remainder of the counterbalance system during the closing and opening of a sectional door. More specifically, the present invention relates to cable storage drums having a small diameter and reduced length to minimize possible interference between the cable and door or door frame without sacrificing operational capabilities of the counterbalance system.

BACKGROUND ART

Spring counterbalance systems have been commonly used to counterbalance overhead doors such as sectional garage doors. For many years, sectional doors have employed torsional counterbalance systems using the rotational forces of this system to assist in controlling the lifting and lowering of the door by means of cables or other flexible members attached to the bottom of the door and to cable storage drums normally mounted proximate the ends of a drive tube or shaft of the counterbalance system. These cable storage drums manage and store the cable by providing guiding grooves that are machined or cast into the drums to guide the lift cables on and off of the cable storage drum and prevent the coils from rubbing against themselves or coiling on top of each other.

With these conventional systems, a single layer of cable is wrapped around the outside diameter of the cable storage drum. This single wrapping of the stored cable necessitates a drum length adequate to store the cable when the door is in the open position i.e. when the majority of the cable has been wound onto the drum. As can be appreciated, the diameter of the cable storage drum also affects the drum length needed to accommodate the stored cable but, the diameter of the cable storage drum is largely a matter of available space and other design factors. In some cases, a desired small diameter of the drum requires a drum of such a length that it causes the cable to pass in front of the door as it is wound. In these designs it is possible under certain circumstances for the cable to catch or hang up on the door.

A separate concern is raised by the winding and unwinding of the cable drum. Grooves in the drum's surface have been used to space and guide the cables on and off of the drum to prevent the cables from abrading each other or from becoming entangled. Alternative designs have incorporated cable guides such as levelers, windlesses, and traversing devices. These devices typically guide the cable by imparting a lateral force to the cable by means of spring loaded members, hydraulic actuators, or by using the tension on the cable itself. While these guide devices adequately manage the cable on cable storage systems for some types of applications, they are somewhat complicated and expensive and typically require added space. Consequently, it is desirable to provide a cable storage drum that guides the cable as it is wound and unwound without the necessity of a separate complex guide mechanism.

Relatedly, it is known to use cable drums adapted to handle multiple layers of cable in hoists, winches and other applications where great lengths of cable must be handled. Cable drums used in counterbalance systems for sectional overhead doors employ relatively short cables so that single cable layer drums are universally employed to thereby avoid problems attendant the use of additional cable layers which increase the effective diameter of the drum thereby changing the torsional lever arm. The change in lever arm affects performance of the counterbalance system during opening and closing the door. When the cable is paid out, with the door in the closed position, in a conventional counterbalance system a large amount of force is necessary to lift the door. To compensate for this condition, installers often over tighten the springs to give the door an over-tensioned condition referred to as "hot off the floor" causing the door to continue open after it is moved. The "hot off the floor" condition is desirable for people who would otherwise have difficulty raising a door without an operator. But, the linear spring tension causes the door to be difficult to pull down from the open position. To endeavor to alleviate this problem, known designs add ropes or handles to the door to assist in moving the door from the open position.

DISCLOSURE OF THE INVENTION

Therefore, an object of the present invention is to provide a counterbalancing system for sectional doors which is highly compact and contemplates the storage of multiple layers of cable on the cable storage drums. Another object of the present invention is to provide such a counterbalancing system wherein the cable storage drums may be of such a reduced length due to the multiple layers of cable such that the cable storage portion of the cable drums need be no wider than the distance between the track system and the edge of the door, whereby the cable does not catch on or engage the door during opening and closing of the door. A further object of the invention is to provide such reduced length cable storage drums such that the cable is never visible from the outside of the door and never passes between the door and the door frame where it could hang up on or damage those structural elements.

Another object of the present invention is to provide a counterbalance system for sectional doors wherein a fixed structural flange with an undercut or reverse bevel on the cable storage drums effects proper wrapping of the cables. A further object of the present invention is to provide such a counterbalance system which provides control of the wrapping of the cables on the cable storage drums without springs, levers, gears, guides, traversing devices, or other additional moving parts associated with the drums or cables that might require adjustment or be subject to failure. Yet another object of the invention is to provide such a counterbalance system wherein the cable storage drums may remain of a compact design to accommodate limited space constraints while providing open access to the drums.

Still another object of the present invention is to provide a counterbalance system for sectional doors in which reduced force is required to move the door out of the open position due to the mechanical advantage achieved by stacking the cables in layers on the cable storage drums. A still further object of the invention is to provide such a counterbalance system which may be over-tensioned to provide continued movement of a door once opening movement commences while providing the reduced force requirement for moving the door from the open position. Yet another object of the invention is to provide such a counterbalance system wherein the cable storage drums can be of a reduced diameter without an increase in length or a cable drum of the same diameter and length can be used to store the cables of a much taller door. Another object of the invention is to provide a counterbalance system wherein the varied force imparted by layering the cables on the cable drums permits variations in the design of the counterbalance springs to achieve easier door opening and closing operations by the system.

Yet a further object of the invention is to provide a counterbalance system for sectional doors wherein the cable storage drum design allows layered storage of the cables without increased cable chaffing and noise during operation. Another further object of the invention is to provide a cable storage drum configuration which can be retrofitted on existing doors, can be easily and inexpensively manufactured, and is not prone to damage or wear which would impair operation or require replacement.

In general, the present invention contemplates a counterbalance system for an upwardly acting door movable on tracks between a closed position and an open position having, a drive tube adapted to be mounted above the door in the closed position, a cable drum assembly mounted proximate each end of the drive tube, a cable connecting each cable drum assembly and the door, a cylindrical member on the cable drum assembly, a cable receiving surface on the cylindrical member extending laterally between the door and the tracks and receiving multiple layers of the cable during movement of the door from the closed position to the open position, whereby the cable avoids engagement with the door during movement between the closed position and the open position.

PREFERRED EMBODIMENT FOR CARRYING OUT THE INVENTION

Figure 1:
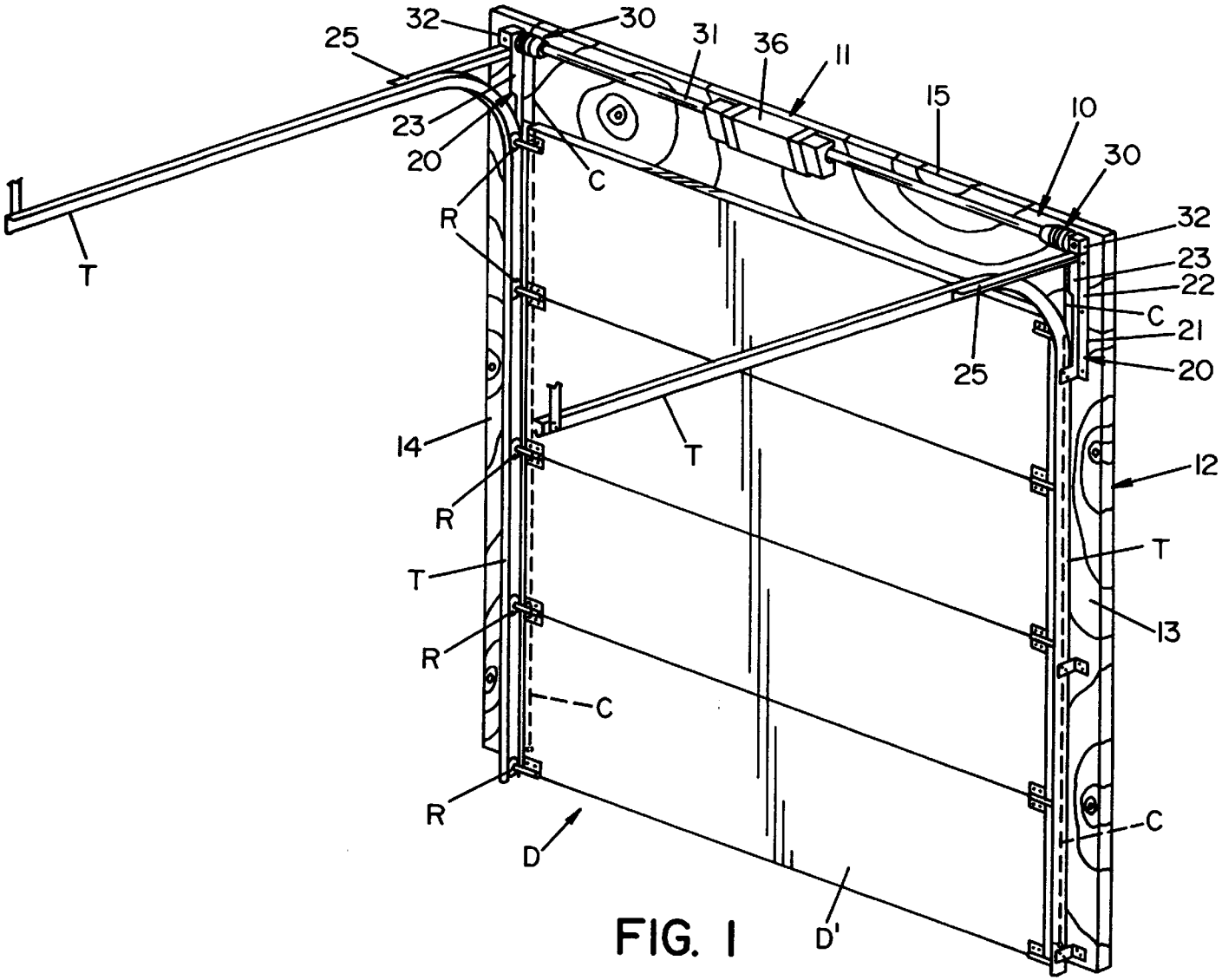
FIG. 1 is an interior perspective view of an upwardly acting sectional door with a counterbalancing system having compact cable drums according to the concepts of the present invention.
Figure 2:
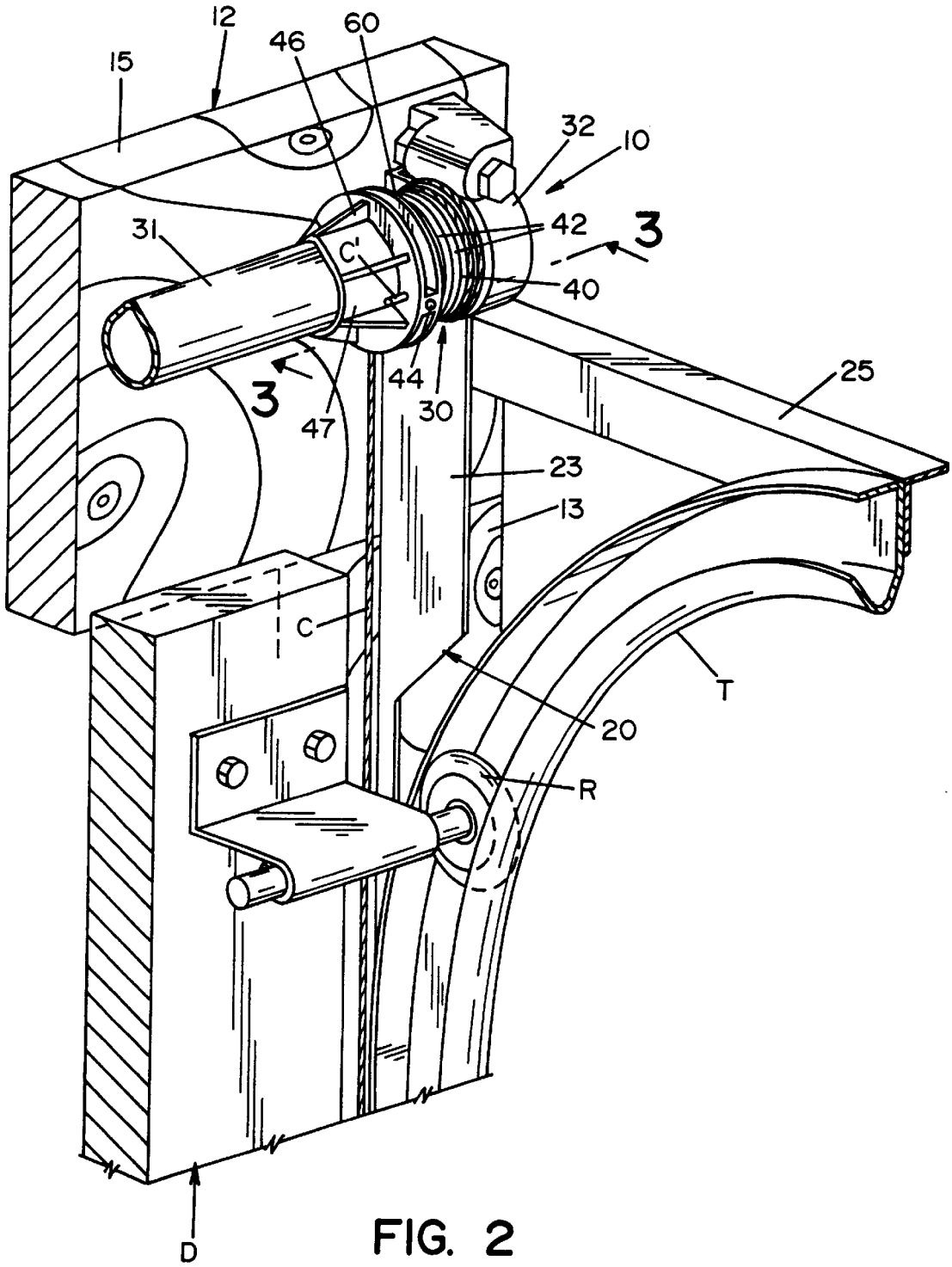
FIG. 2 is an enlarged fragmentary perspective view depicting a cable drum to the right side of a door as seen in FIG. 1 showing details of the interrelation with the door and other elements of the counterbalancing system.

A counterbalance system incorporating the concepts of the present invention is generally indicated by the numeral 10 in FIGS. 1 and 2 of the drawings. The counterbalance system 10 is shown mounted in conjunction with a conventional sectional door, generally indicated by the letter D, and may include an operator system, generally indicated by the numeral 11, of a type commonly employed in garages or residential housing. The opening in which the door D is positioned for opening and closing movements relative thereto is defined by a frame, generally indicated by the numeral 12, which consists of a pair of spaced jambs 13, 14 that, as seen in FIG. 1, are generally parallel and extend vertically upwardly from the floor (not shown). The jambs 13, 14 are spaced and joined at their vertically upward extremity by a header 15 to thereby delineate a generally inverted U-shaped frame 12 around the opening for the door D. The frame 12 is normally constructed of lumber, as is well known to persons skilled in the art, for purposes of reinforcement and facilitating the attachment of elements supporting and controlling door D, including the operator system 11.

Affixed to the jambs 13, 14 proximate the upper extremities thereof and the lateral extremities of the header 15 to either side of the door D are flag angles, generally indicated by the numeral 20. The flag angles 20 generally consist of L-shaped vertical members 21 having a leg 22 attached to an underlying jamb 13, 14 and a projecting leg 23 preferably disposed substantially perpendicular to the leg 22 and, therefore, perpendicular to the jambs 13, 14.

Flag angles 20 also include an angle iron 25 positioned in supporting relation to tracks T, T located to either side of door D. The tracks T, T provide a guide system for rollers R (FIG. 2) attached to the side of door D, in a manner well-known to persons skilled in the art. The angle irons 25 normally extend substantially perpendicular to the jambs 13, 14 and may be attached to the transitional portion of tracks T, T between the vertical section and the horizontal section thereof or in the horizontal section of tracks T, T. The tracks T, T define the travel of the door D in moving upwardly from the closed to the open position and downwardly from the open to the closed position.

The operator system 11 may be electrically interconnected with a ceiling unit (not shown), which may contain a power supply, a light, a radio receiver with antenna for remote actuation and other operating peripherals in a manner known in the art. The operator system 11 may also include a wall unit (not shown) having an up/down button, a light control, and controls for other known functions and a locking mechanism (not shown) to lock the door D in the closed or other preselected positions.

Referring now to FIGS. 1 and 2 of the drawings, the operator system 11 mechanically interrelates with the door D through the counterbalance system 10. As shown, the counterbalance system 10 includes cable drum mechanisms, generally indicated by the numeral 30, and an elongate drive tube 31 extending between tensioning assemblies 32, 32 positioned proximate each of the flag angles 20. While the exemplary counterbalance system 10 depicted herein is advantageously in accordance with U.S. Pat. No. 5,419,010, to which reference is hereby made for structure and operating details, except for the cable drum mechanism 30, it will be appreciated by persons skilled in the art that a variety of known torsion-spring counterbalance systems could be employed.

As shown, the cable drum mechanisms 30 are positioned on the drive tube 31 proximate the ends thereof and in all instances rotate with drive tube 31. Cable drums 30 each have a suspension cable C reeved thereabout which is affixed to the door D preferably near the bottom lower edge of the section D, such that rotation of the cable drum 30 operates to open or close the door D as will be described more fully below.

As seen in FIGS. 1 and 2, the operator system 11 has an operator housing 36 which may conveniently enclose a length of drive tube 31. While drive tube 31 is depicted as a hollow tubular member that is non-circular in cross-section, it is to be appreciated that circular drive tubes, solid shafts, and other types of driving elements that rotate cable drums may be employed in conjunction with the cable drum mechanisms 30 of the instant invention and are encompassed within this terminology in the context of this specification.

Figure 3:
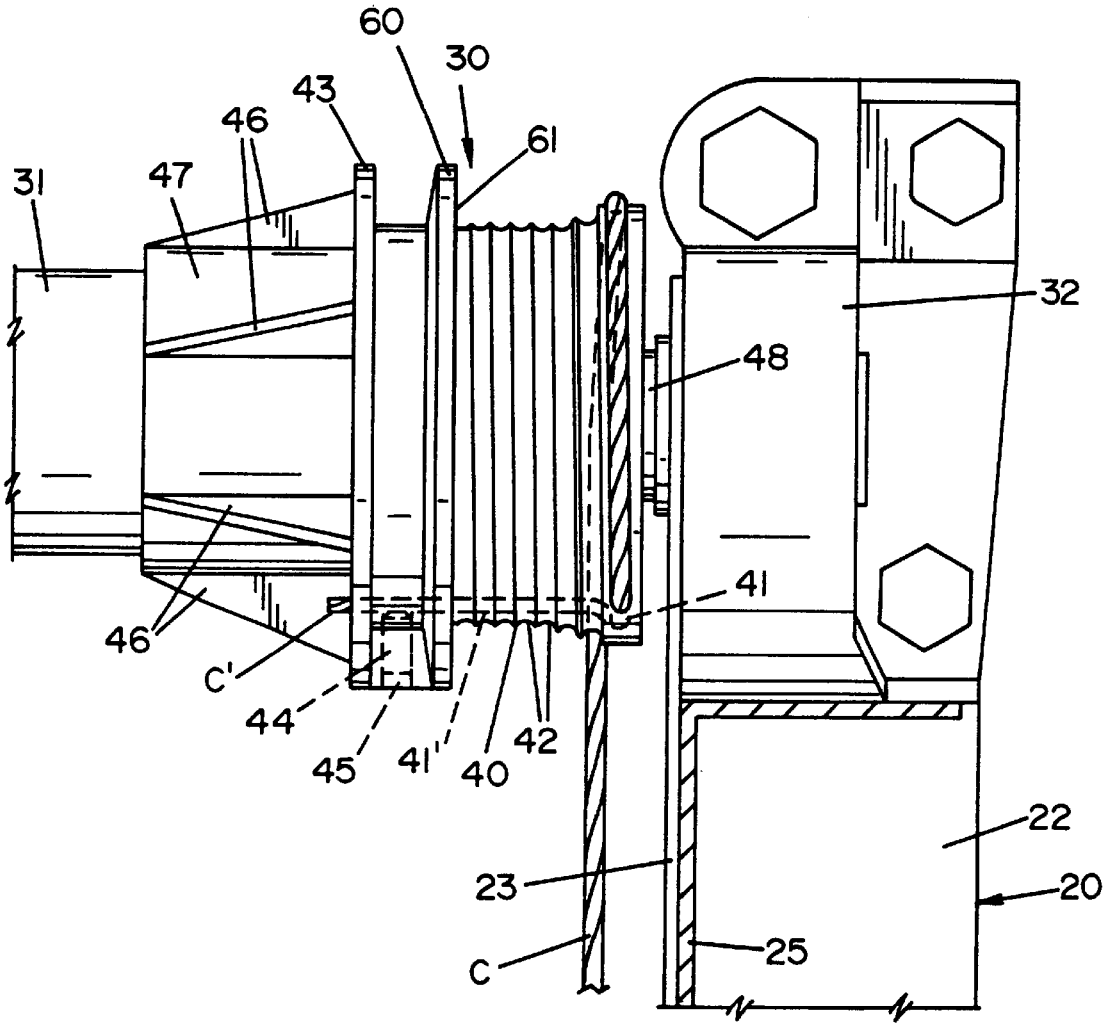
FIG. 3 is a front elevational view taken substantially along line 3—3 in FIG. 2 depicting the cable drum with the door in the closed vertical position of FIG. 1 and the cable substantially unwound from the cable drum.
Figure 4:
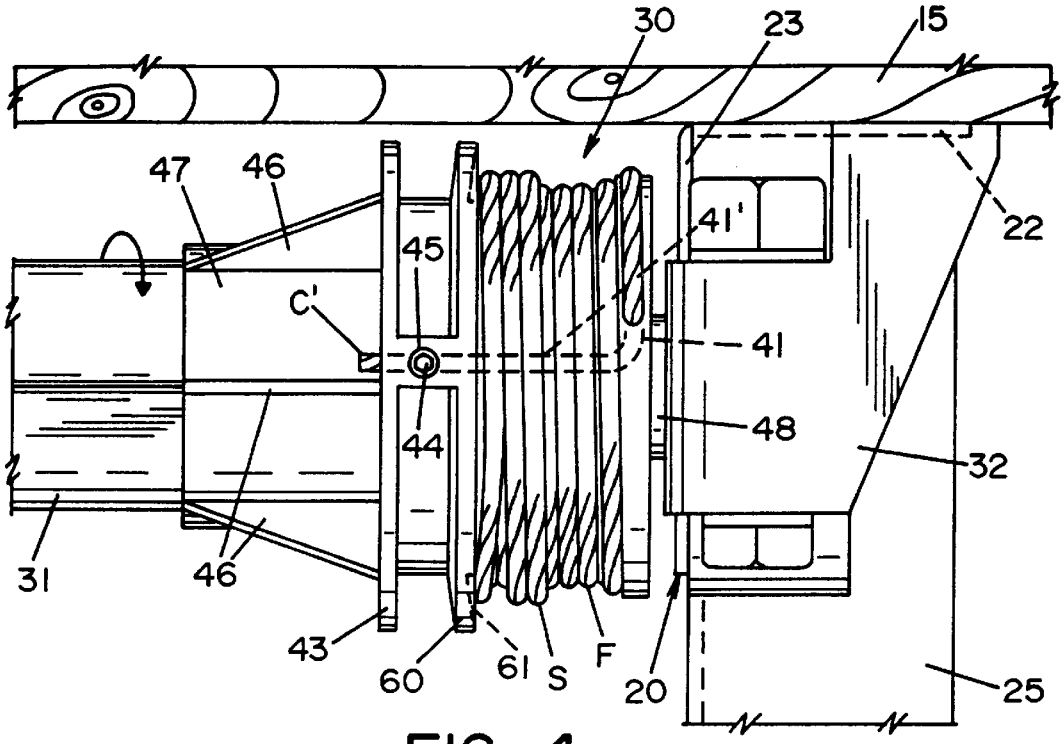
FIG. 4 is a top plan view of the cable drum depicting a first layer of cable wound on the cable drum and a second layer of cable partially wound on the cable drum as might be seen when the door is being raised.
Figure 5:
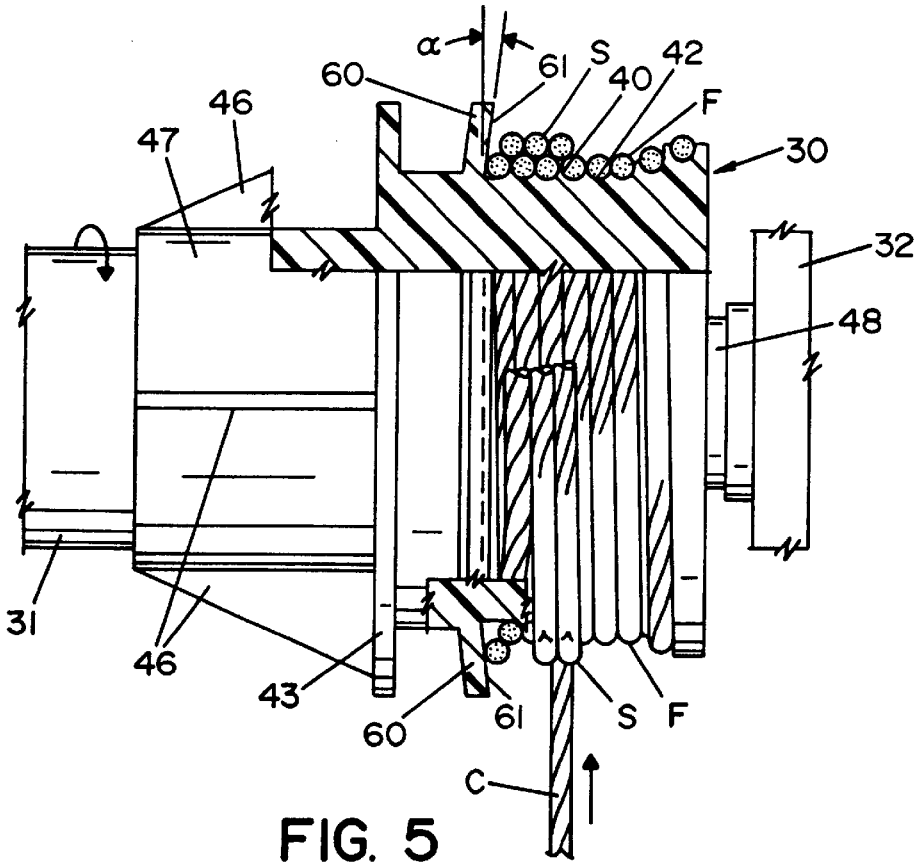
FIG. 5 is an elevational view similar to FIG. 3 with portions of the cable drum and cable show in section and in an intermediate position while depicting the overlapped relationship of the layers of cable with the door in substantially the intermediate position depicted in FIG. 4.

Since the cable drum mechanisms 30 at either end of the drive tube 31 are structurally identical only the one at the right end of door D as viewed in FIG. 1 is described in detail. As best seen in FIGS. 3–5, the cable drum mechanism 30 has a substantially cylindrical external surface 40 over a substantial portion of its axial length. While cylindrical external surface 40 could be smooth, it is preferably provided with continuous helical grooves 42 therein which are angled inwardly from the axial outer end. The helical grooves 42 are adapted for receiving and seating the suspension cable C therein to provide cable guidance and reduce cable abrasion.

The cable C is attached at one end to a point on the door D, preferably at substantially the bottom of the lowermost panel D' of the door D (FIG. 1). The other end C' of the cable C is affixed to the cable drum 30 for selective retention and release when a cable C is installed, replaced or adjusted. In this respect, an angular bore 41 extends into the cable drum 30 preferably proximate one extremity of the helical grooves 42 and connects with an axial bore 41' extending the length of external surface 40 and preferably through a radially projecting flange 43 extending from external surface 40. The bores 41 and 41' are sized to adjustably receive the cable C. A hex screw 44 is positioned in a tapped radial bore 45 which intersects with the bore 41'. Thus, the hex screw 44 may be tightened to retentively engage end C' of cable C and released by loosening the hex screw 44 to remove end C' of cable C from the bore 41' or to alter the position of cable C therein to adjust the length of cable C extending outwardly of the external surface 40 of cable drum mechanism 30. The end of cable drum 30 axially outwardly of flange 43 on the side opposite external surface 40 has a projecting sleeve 47 which receives drive tube 31 and which may be provided with a plurality of circumferentially-spaced reinforcing ribs 46.

The cable drum 30 is preferably mounted on the drive tube 31 and inwardly configured to match the non-circular outer configuration of drive tube 31 as detailed in the aforementioned U.S. Pat. No. 5,419,010. As a result, the cable drum 30 is non-rotatably affixed to, and therefore at all times rotates with, the drive tube 31. The axial end of cable drum 30 opposite the sleeve 45 receives a gear shaft 48 which supports the cable drum while providing for an extent of axial movement of drive tube 31 to avoid possible binding or frictional interference as described in the aforementioned U.S. Pat. No. 5,419,010.

Positioned on external surface 40 of cable drums 30 is an upstanding flange 60 which extends outwardly from a position proximate helical grooves 42. The flange 60 has a guide surface 61 which extends axially inwardly toward helical grooves 42 to impart an axial force against cable C when in winding contact therewith. Flange 60 is preferably substantially annular or beveled and extends radially outwardly from the external surface 40 of cable drum 30. Guide surface 61 may carry an inwardly extending portion, for example a protrusion, such that a first winding layer F coming in contact therewith is axially deflected to form a second winding layer S. As shown in FIGS. 3–5, guide surface 61 of flange 60 extends axially inwardly while progressing radially outwardly to define an angular surface that displaces cable C to institute a second winding layer of cable C as it is directed toward the opposite end of cable drum 30. Preferably, guide surface 61 extends at an angle in the range of approximately 5° to 9° and preferably about 7° to a direct radial projection at 90° to the external surface 40 of cable drum 30. Flange 60 and guide surface 61 project radially outwardly a sufficient distance to engage the outmost of two or more layers of cable C.

In operation, when operating door D, cable C is wound onto drum 30. Due to a shortened axial length of drum 30, the cable C forms more than one layer. Further, the shortened axial length of cable drum 30 containing helical grooves 42 maintains the cable C substantially within the lateral space between the track T and the door D. In this way, the cable C does not interfere with the raising and lowering of door D and the likelihood of cable C engaging or becoming entangled with door D is substantially eliminated. As the door D is actuated from the closed, vertical position to effect opening, the first winding layer F of cable C seats along the helical grooves 42 until contacting flange 60. Flange 60 stops the axial progression of cable C and its angled inner surface 61 forces cable C back upon itself in a second layer winding S, thereby reversing the axial progression. The inward extension of flange 60 causes cable C of second winding layer S to overlap the first winding layer F in an angular direction substantially opposite or at an angularly offset lead angle to the direction of the first winding layer F. In this way, the second winding layer S of cable C is positioned on top of the windings of the first winding layer F. This prevents the cable C from abrading the underlying first layer F by winding into the depressions between the windings of first layer F. The overlapping contact of first and second winding layers F, S reduces the amount of abrasion by reducing the amount of contact between the adjacent layers. As can be readily understood, when the cable C falls between windings of the first layer F, it experiences contact on the radially inner surface and sides of the cable. When overlapping, the contact is limited to essentially the radially inner surface of cable C with reduced abrasion that results in a reduction in the noise generated by the winding of the cable C.

Thus, it should be evident that a cable drum for doors disclosed herein carries out one or more of the objects of the present invention set forth above and otherwise constitutes an advantageous contribution to the art. As will be apparent to persons skilled in the art, modifications can be made to the preferred embodiment disclosed herein without departing from the spirit of the invention, the scope of the invention being limited solely by the scope of the attached claims.

What is claimed is:

1. A counterbalance system operatively interrelated with an upwardly acting door movable on tracks between a closed position and an open position comprising, a drive tube adapted to be mounted above the door in the closed position, a cable drum assembly mounted at an end of said drive tube, a cable connecting said cable drum assembly and the door, a cylindrical cable receiving surface on said cable drum assembly, an extent of continuous helical grooves on said cylindrical surface extending a limited axial distance aligned with and substantially equal to the lateral space between the door and the tracks and receiving multiple layers of said cable during movement of the door from the closed position to the open position, whereby the cable operates in said lateral space between the door and the tracks thereby avoiding engagement with the door and the tracks during movement of the door.

2. A counterbalance system according to claim 1, wherein a flange extends generally radially from said cylindrical member to redirect said cable when wound in one axial direction to form a first layer and in the opposite axial direction to form a second layer overlying said first layer.

3. A counterbalance system according to claim 2, wherein said flange has a guide surface extending radially and axially of said cylindrical member in the direction of said cable receiving surface.

4. A counterbalance system according to claim 3, wherein said guide surface is oriented at an angle of approximately 5° to 9° relative to a line perpendicular to said cable receiving surface.

5. A counterbalance system according to claim 3, wherein said guide surface is oriented at an angle of about 7° relative to a line perpendicular to said cable receiving surface.

6. A counterbalance system according to claim 1, further comprising a projecting guide on said cylindrical cable receiving surface instituting the creation of multiple layers of said cable.

7. A counterbalance system according to claim 1, wherein said cable drum has a cable contacting flange at one axial extremity of said cable receiving surface, said flange having an inner surface angled toward said cable receiving surface and the other axial extremity for redirecting said cable in the opposite axial direction after winding a first layer of said cable on said cable receiving surface and preparatory to winding a second layer of said cable overlying said first layer of said cable.

* * * * *